US007507127B2

(12) United States Patent
Nagata et al.

(10) Patent No.: US 7,507,127 B2
(45) Date of Patent: Mar. 24, 2009

(54) CABLE ATTACHMENT, CABLE ASSEMBLY INCLUDING THE SAME, AND CONNECTOR INCLUDING THE ASSEMBLY

(75) Inventors: Takayuki Nagata, Yao (JP); Hayato Kondo, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 11/987,467

(22) Filed: Nov. 30, 2007

(65) Prior Publication Data

US 2008/0132112 A1 Jun. 5, 2008

(30) Foreign Application Priority Data

Dec. 4, 2006 (JP) ..... 2006-327424

(51) Int. Cl.
*H01R 13/02* (2006.01)

(52) U.S. Cl. ..... 439/885; 439/878

(58) Field of Classification Search ..... 439/885, 439/878

See application file for complete search history.

(56) References Cited

U.S. PATENT DOCUMENTS 4,737,115 A * 4/1988 Seidler ..... 439/83
6,637,106 B2 * 10/2003 Sato et al. ..... 29/878

FOREIGN PATENT DOCUMENTS

JP 11-260439 9/1999
JP 2006-54102 2/2006

* cited by examiner

*Primary Examiner*—Truc T Nguyen
(74) *Attorney, Agent, or Firm*—Kratz, Quintos & Hanson, LLP

(57) ABSTRACT

A cable attachment includes a base portion bent such that a first end portion and a second end portion are oriented in the same direction; a plurality of first type of attachment portions that are arranged in spaced relation to each other along a length of the first end portion of the base portion; and a plurality of second type of attachment portions that are arranged in spaced relation to each other along a length of the second end portion of the base portion. The first type of attachment portions and the second type of attachment portions are alternately disposed in the length direction.

20 Claims, 6 Drawing Sheets

CABLE ATTACHMENT, CABLE ASSEMBLY INCLUDING THE SAME, AND CONNECTOR INCLUDING THE ASSEMBLY

The present application claims priority under 35 U.S.C. §119 of Japanese Patent Application No. 2006-327,424 filed on Dec. 14, 2006, the disclosure of which is expressly incorporated by reference herein in its entity.

BACKGROUND OF THE ART

1. Field of the Invention

The present invention relates to a cable attachment for attachment thereto of a plurality of cables in a parallel arrangement, and a cable assembly and a connector that include the cable attachment.

2. Description of the Related Art

For a conventional connection structure of a plurality of cables to a connector, there is one in which a plurality of cables are respectively fixed, by applying pressure, to a plurality of contacts and the contacts are incorporated one by one into a body of the connector. This connection structure has a drawback that when the number of cables increases, it takes time to fix cables respectively to contacts by applying pressure and incorporate the contacts into a body. Moreover, since cables are connected one by one, there is another drawback that such connection structure is apt to cause wiring errors.

In view of these drawbacks, there is another connection structure in which a plurality of cables are attached to attachment hardware and the attachment hardware is then attached to a body of the connector while the plurality of cables are respectively brought into contact with a plurality of contacts of the connector, whereby the plurality of cables are connected to the connector at once.

As examples of such attachment hardware, there are one to which a plurality of cables are attached by soldering or the like, and one in which a plurality of cables are sandwiched respectively by a plurality of attachment portions which are arranged on the above-described attachment hardware so as to be spaced apart from one another in a length direction (see Japanese Patent Application Laid-Open No. 11-260439 and Japanese Patent Application Laid-Open No. 2006-54102, for example).

The former example has a drawback that if cables are single-core cables or the like whose outer peripheries are covered with insulators, the cables are not adapted for soldering. Even if cables are coaxial cables or the like that have solderable shields, the shield may be hardened by soldering. Thus, there is another drawback that when the cables are bent, the shields may break.

The latter example does not have drawbacks such as those of the former. Attachment portions are formed by being cut and raised from a plate body to serve as attachment hardware. In addition, in order that attachment portions suitably sandwich cables, the attachment portions require a developed length that corresponds to the outer diameter of the cables.

Hence, through to miniaturization of connectors, spaces between cables become smaller, three times or less than the outer diameter of the cables. When an attempt is made to set the same spaces between the attachment portions as the spaces between the cables, the attachment portions may not have sufficient developed lengths to suitably sandwich cables because those attachment portions are cut and raised from a plate body.

In short, the latter attachment hardware has an essential drawback, that is, when the spaces between cables are small relative to outer diameters of the cables, it is impossible to dedicate enough developed lengths of the attachment portions.

SUMMARY OF THE INVENTION

The present invention is made in view of the above-described circumstances and an object of the present invention is therefore to provide a cable attachment that allows for developed lengths of attachment portions even when the spaces between cables are small relative to outer diameters of the cables, and a cable assembly and a connector that include the cable attachment.

In order to solve the above-described problems, the present invention provides a cable attachment for attachment thereto of a plurality of first cables in a parallel arrangement, the cable attachment including a base portion bent such that first and second widthwise end portions thereof are oriented in a same direction; a plurality of first type of attachment portions, arranged in spaced relation to each other along a length of the first end portion of the base portion, for attachment thereto of the corresponding first cables; and a plurality of second type of attachment portions, arranged in spaced relation to each other along a length of the second end portion of the base portion, for attachment thereto of the corresponding first cables, wherein the first type of attachment portions and the second type of attachment portions are disposed alternately in the length direction of the base portion.

Since the first and second type of attachment portions are thus arranged alternately in the length direction on the first and second end portions of the base portion, the space between any first type of attachment portion and an adjacent second type of attachment portions can be reduced, and at the same time, the space between two neighboring first type of attachment portions and the space between two neighboring second type of attachment portions can be made larger than the space between any first type of attachment portion and the adjacent second type of attachment portion. Therefore, when cutting and raising the first and second type of attachment portions from a plate body, sufficient developed lengths to suitably sandwich cables can be dedicated.

Preferably, the first type of attachment portions each include a first supporting portion continuing to the base portion for placing a corresponding one of the first cables thereon; and a pair of first sandwiching portions, provided at opposite ends of the first supporting portion so as to be oriented in a direction intersecting the length direction, for sandwiching the first cable placed on the first supporting portion. It is preferable that the second type of attachment portions each include a second supporting portion, continuing to the base portion, for placing a corresponding one of the first cables thereon; and a pair of second sandwiching portions, provided at opposite ends of the second supporting portion so as to be oriented in a direction intersecting the length direction, for sandwiching the first cable placed on the second supporting portion. The supporting portions of at least one type, namely the first supporting portions and/or the second supporting portions, are preferably bent such that cable placing sides of the first supporting portions are arranged flush with cable placing sides of the second supporting portions.

By thus arranging the cable placing sides of the first supporting portions flush with the cable placing sides of the second supporting portions, the plurality of first cables can be arranged flush with one another when placed on the supporting portions. Accordingly, upon connecting the plurality of first cables to a plurality of contacts of a connector, they can be easily aligned with one another in height. As a result, the plurality of first cables can be easily connected to the plurality of contacts of the connector.

A first cable assembly of the present invention includes the above-described cable attachment; and the plurality of first cables for attachment to the respective first and second type of attachment portions of the cable attachment. The first cables may be selected from single-core cables, coaxial cables and twin cables or may be any combination of the three types.

A second cable assembly of the present invention includes the above-described cable attachment; and the plurality of first cables for attachment to the respective first and second type of attachment portions of the cable attachment. The first cables may be selected from coaxial cables and twin cables or may be the combination of the two types. Shields of the first cables may be attached to the respective first and second type of attachment portions.

By thus attaching the shields of the cables to the first and second type of attachment portions, respectively, the cable attachment can also be used as a shield terminal.

The above-described cable attachment may also be adapted to receive a second cable in addition to the first cables. In this case, the cable attachment further may include a third attachment portion, provided on the first end or the second end of the base portion, for attaching the second cable.

By thus providing the third attachment portion, the second cable of a different type than first cables can be attached. That is, the above-described cable attachment is may be adapted for a plurality of types of cables.

A third cable assembly of the present invention includes the above-described cable attachment; the plurality of first cables for attachment to the respective first and second type of attachment portions of the cable attachment; and the second cable for attachment to the third attachment portion of the cable attachment. The first cables may be selected from single-core cables and coaxial cables or may be the combination of the two types. The second cable may be a twin cable.

A fourth cable assembly of the present invention includes the above-described cable attachment; the plurality of first cables for attachment to the respective first and second type of attachment portions of the cable attachment; and the second cable for attachment to the third attachment portion of the cable attachment. The first cables may be coaxial cables and shields of the first cables are attached to the respective first and second type of attachment portions. The second cable may be a twin cable and a shield of the second cable is attached to the third attachment portion.

By thus attaching the shields of cables to the first and second type of attachment portions, respectively, the cable attachment can also be used as a shield terminal.

A first connector of the present invention includes the first or third cable assembly; and a plurality of contacts for connection with the cables.

A second connector of the present invention includes the second or fourth cable assembly; a plurality of contacts for connection with the cables; and a shield terminal for contact with the cable attachment.

In a cable attachment of the present invention, when cutting and raising the first and second type of attachment portions from the plate body, a developed length required for the first and second type of attachment portions will have sufficient lengths as developed. A cable assembly including such a cable attachment will allow a plurality of first cables to be connected to contacts of the connector at once, easily establishing a connection to the connector, resulting in reduced costs. In addition, the above-described cable assembly can cope with narrow pitch spacing between a plurality of first cables, also achieving miniaturization of the connector.

BRIEF DESCRIPTION OF THE DRAWINGS

FIG. 2(*b*) shows an enlarged perspective view of an a portion of the attachment.

DESCRIPTION OF THE PREFERRED EMBODIMENTS

A cable assembly according to each embodiment of the present invention will be described below.

First Embodiment

Figure 1:
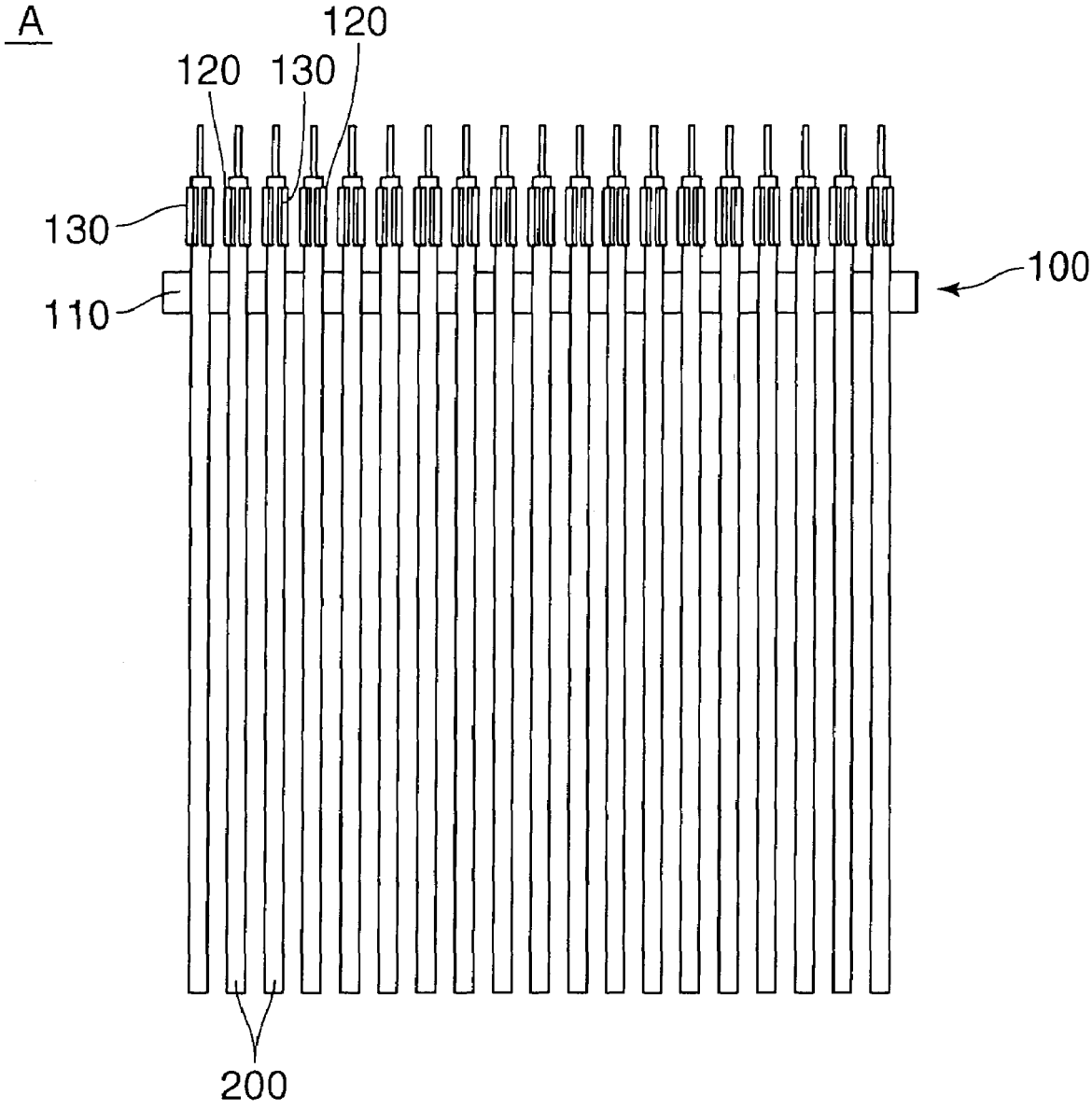
FIG. 1 shows a schematic plan view of a cable assembly according to a first embodiment of the present invention.
Figure 2:
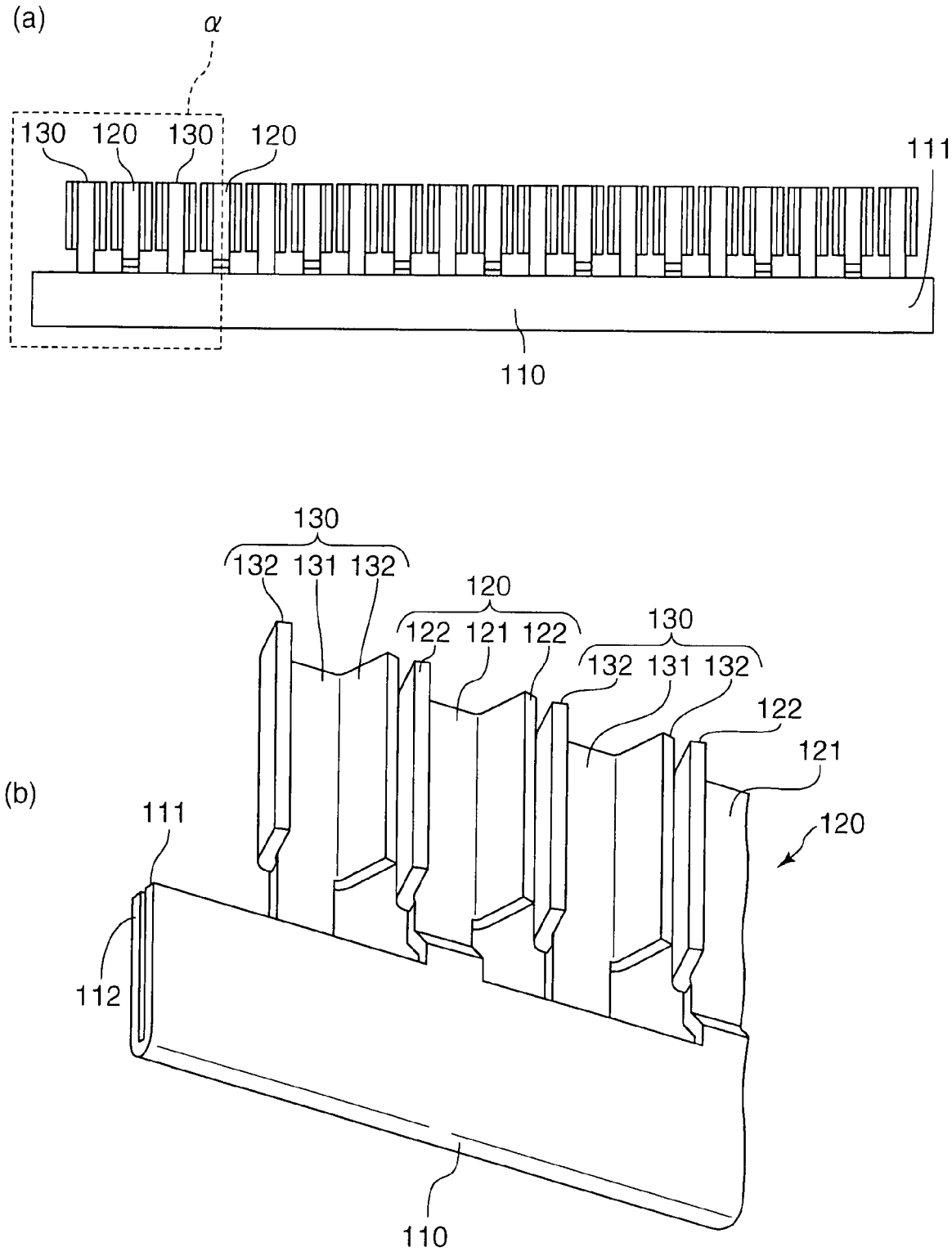
FIG. 2(*a*) shows a schematic plan view of a cable attachment of the cable assembly.
Figure 3:
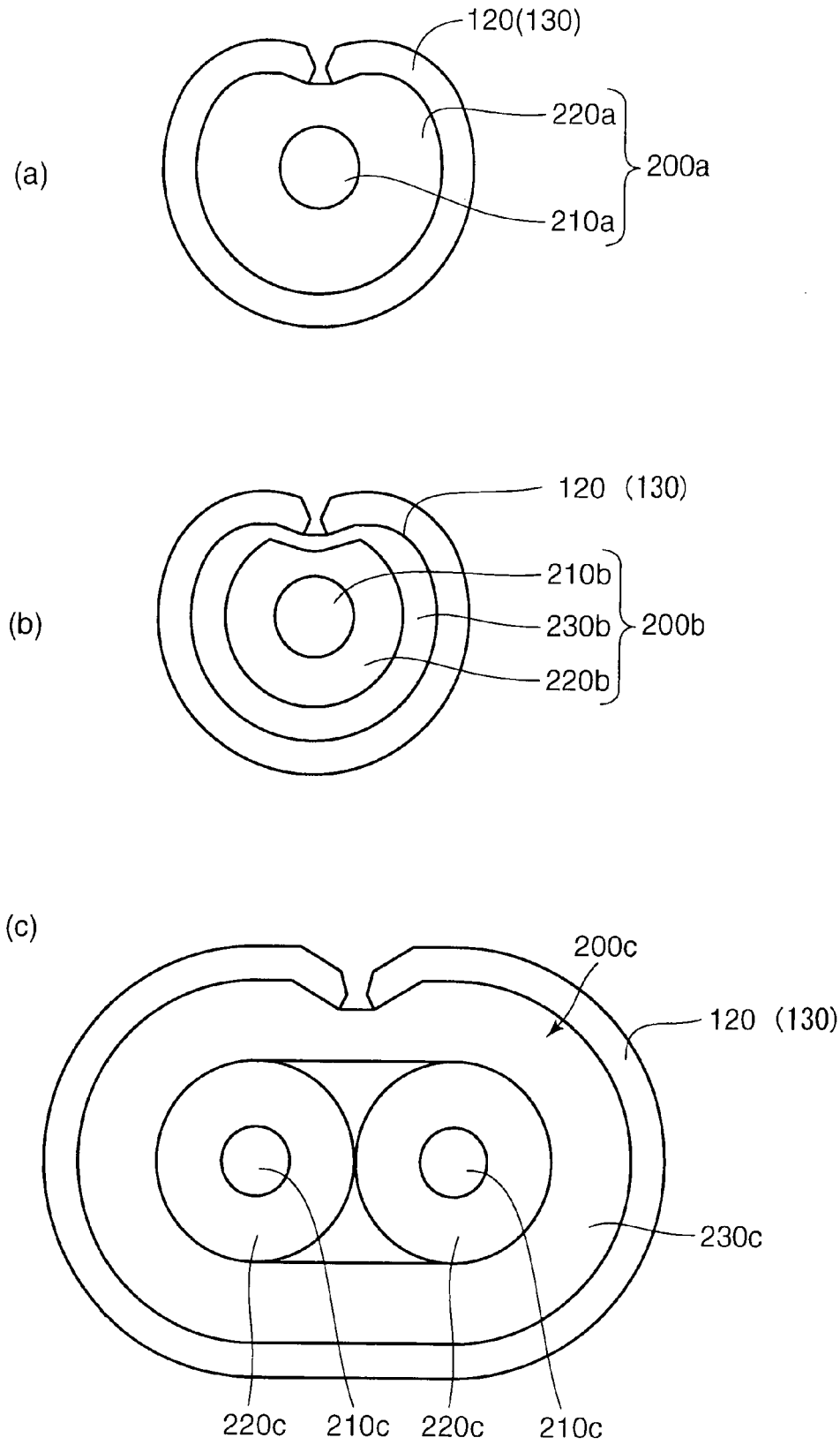
FIG. 3 shows a schematic cross-sectional view illustrating a state in which a cable is attached to a first or second type of attachment portion of the cable attachment of the cable assembly, particularly, FIG. 3(*a*) illustrates a state in which a single-core cable is attached, FIG. 3(*b*) illustrates a state in which a coaxial cable is attached, and FIG. 3(*c*) illustrates a state in which a twin cable is attached.

First, a cable assembly according to a first embodiment of the present invention will be described with reference to the drawings. FIG. 1 is a schematic plan view of the cable assembly according to the first embodiment of the present invention; FIG. 2(*a*) is a schematic plan view of a cable attachment of the cable assembly, and FIG. 2(*b*) is an enlarged perspective view of an a portion of the attachment; and FIG. 3 is a schematic cross-sectional view illustrating a state in which a cable is attached to a first or second type of attachment portion of the cable attachment of the cable assembly, particularly, FIG. 3(*a*) illustrates a state in which a single-core cable is attached, FIG. 3(*b*) illustrates a state in which a coaxial cable is attached, and FIG. 3(*c*) illustrates a state in which a twin cable is attached.

A cable assembly "A" as shown in FIG. 1 includes a cable attachment 100 and a plurality of first cables 200 attached to the cable attachment 100 in a parallel arrangement to one another. Each element of the cable assembly will be described in detail below.

As shown in FIGS. 1 and 2(*a*) and (*b*), the cable attachment 100 includes a base portion 110; a plurality of first type of attachment portions 120 arranged in spaced relation to each other along a length of a first end portion 111 of the base portion 110; and a plurality of second type of attachment portions 130 arranged in spaced relation to each other along a length of a second end portion 112 of the base portion 110. The first type of attachment portions 120 and the second type of attachment portions 130 are alternately disposed in the length direction. Note that the space between any first type of attachment portion 120 and an adjacent second type of attachment portion 130 is three times or less than the outer diameter of the corresponding first cable 200.

The base portion 110 is a long plate body having conductivity and being bent into a substantially U-shape such that the two widthwise ends thereof, namely the first end portion 111 and the second end portion 112, are oriented in the same direction. In other words, the end face of the first end portion 111 and the end face of the second end portion 112 face in the same direction.

As shown in FIGS. 2(*b*) and 3, the first type of attachment portions 120 each are a part having a substantially U-shape in cross section. Each is formed of a first supporting portion 121, continuing to the first end portion 111 of the base portion 110, and a pair of first sandwiching portions 122, provided at opposite ends of the first supporting portion 121 so as to be oriented in a direction intersecting the longitudinal direction of the attachment 100.

Similarly, the second type of attachment potions 130 each are, as shown in FIGS. 2(*b*) and 3(*a*) to 3(*c*), a part having a substantially U-shape in cross section. Each is formed of a second supporting portion 131, continuing to the second end portion 112 of the base portion 110, and a pair of second sandwiching portions 132, provided at opposite ends of the second supporting portion 131 so as to be oriented in the direction intersecting the longitudinal direction of the attachment 100.

The first supporting portions 121 are plate-like bodies for placing the respective first cables 200 thereon. As shown in FIG. 2(*b*), base ends of first supporting portions 121 are bent such that top faces (the side for placing cables) of the distal ends of the first supporting portions 121 are flush with top faces (the side for placing cables) of second supporting portions 131. The second supporting portions 131 are straight plate-like body for placing the first cable 200 thereon.

The pair of first sandwiching portions 122 is to be swaged to sandwich the first cable 200 placed on the first supporting portion 121. The pair of second sandwiching portions 132 is the same as the pair of first sandwiching portions 122.

The sum of a width dimension of the first supporting portion 121 and a width dimension of the pair of first sandwiching portions 122 is substantially the same as the length of an outer periphery of the first cable 200. Similarly, the sum of a width dimension of the second supporting portion 131 and a width dimension of the pair of second sandwiching portions 132 is also substantially the same as the length of the outer periphery of the first cable 200. Accordingly, the first and second type of attachment portions 120 and 130 each can cover substantially the entire outer periphery of the first cable 200.

As the first cables 200, as shown in FIGS. 3(*a*) to 3(*c*), at least one of a single-core cable 200*a*, a coaxial cable 200*b*, and a twin cable 200*c* can be used.

As shown in FIG. 3(*a*), the single-core cable 200*a* is a known one having a signal line 210*a* and an outer insulator 220*a* sheathing the signal line 210*a*.

As shown in FIG. 3(*b*), the coaxial cable 200*b* is a known one having a signal line 210*b*, an inner insulator 220*b* sheathing the signal line 210*b*, a shield 230*b* covering the inner insulator 220*b*, and an outer insulator (not shown) sheathing the shield 230*b*.

As shown in FIG. 3(*c*), the twin cable 200*c* is a known one having two signal lines 210*c*, two inner insulators 220*c* respectively sheathing the two signal lines 210*c*, a shield 230*c* covering the two inner insulators 220*c*, and an outer insulator (not shown) sheathing the shield 230*c*.

A method of manufacturing the cable attachment 100 will be described below. First, a first widthwise end of a conductive long plate body is cut to form a plurality of the first type of attachment portions 120 including the first supporting portions 121 and pairs of first sandwiching portions 122 as developed. Along with this, a second widthwise end of the plate body is cut to form the plurality of second type of attachment portions 130 including the second supporting portions 131 of and the pair of second sandwiching portions 132 as developed.

Thereafter, the plate body is bent in the center into a substantially U-shape such that one end portion (corresponding to the first end portion 111) and the other end portion (corresponding to the second end portion 112) are oriented in the same direction. Accordingly, the plate body serves as a base portion 110.

Thereafter, the base ends of the first supporting portions 121 of first type of attachment portions 120 are bent such that the top faces of the distal ends thereof are aligned in height with the top faces of the second supporting portions 131.

Then, the pairs of first sandwiching portions 122 of the first type of attachment portions 120 are bent so as to intersect a length direction of the plate body and the pairs of second sandwiching portions 132 of the second type of attachment portions 130 are also bent in the same direction as the first sandwiching portions 122 so as to intersect a length direction of the plate body.

The cable attachment 100 is thus formed and the steps of attaching the first cables 200 to such cable attachment will be described below. As shown in FIG. 3(*a*), if the first cables 200 are the single-core cables 200*a*, the outer insulators 220*a* at the tip side portions of first end portions of the single-core cables 200*a* are peeled off to expose the signal lines 210*a*. In this condition, as shown in FIG. 1, the outer insulators 220*a* at rear side portions of the first end portions of the single-core cables 200*a* are placed on the respective first and second supporting portions 121 and 131 of the first and second type of attachment portions 120 or 130. Then, the pairs of first and second sandwiching portions 122 and 132 are swaged to sandwich the respective outer insulators 220*a* of the single-core cables 200*a* between the respective first and second sandwiching portions 122 and 132.

As shown in FIG. 3(*b*), if the first cables 200 are the coaxial cables 200*b*, the outer insulators, shields 230*b* and inner insulator 220*b* at the tip side portions of first end portions of the coaxial cable 200*b* are peeled off to expose signal lines 210*b*. Thereafter, the outer insulator at the rear side portions of the first end portions of the coaxial cables 200*b* are peeled off to expose the shields 230*b*. In this condition, the shields 230*b* of the coaxial cables 200*b* are placed on the respective first and second supporting portions 121 and 131 of the first and second type of attachment portions 120 and 130. Then, the pairs of first and second sandwiching portions 122 and 132 are swaged to sandwich the respective shields 230*b* of the coaxial cables 200*b* between the respective first and second sandwiching portions 122 and 132.

As shown in FIG. 3(*c*), if the first cables 200 are the twin cables 200*c*, the outer insulators, shields 230*c* and twins of inner insulators 220*c* at the tip side portions of first end portions of the twin cables 200*c* are peeled off to expose the twins of signal lines 210*c*. Thereafter, the outer insulators at the rear side portions of the first end portions of the twin cables 200*c* are peeled off to expose shields 230*c*. In this condition, the shields 230*c* of the twin cables 200*c* are placed on the respective first and second supporting portions 121 and 131 of the first and second type of attachment portions 120 and 130. Then, the pairs of first and second sandwiching portions 122 and 132 are swaged to sandwich the respective shields 230*c* of the twin cables 200*c* between the respective first and second sandwiching portions 122 and 132.

In a cable assembly A as described above, the first and second type of attachment portions 120 and 130 are arranged alternately in the length direction on the first end portion 111 and the second end portion 112 of the base portion 110.

Therefore, the space between any first type of attachment portion 120 and the adjacent second type of attachment portion 130 can be set to be three times or less than the outer diameter of first cables 200. Also, the space between two neighboring first type of attachment portions 120 and the space between two neighboring second type of attachment portions 130 can be made larger than the space between any first type of attachment portion 120 and the adjacent second type of attachment portion 130. Accordingly, upon cutting and raising the first and second type of attachment portions 120 and 130 from the plate body, a developed length required to suitably sandwich the first cables 200 can be sufficiently taken.

Figure 4:
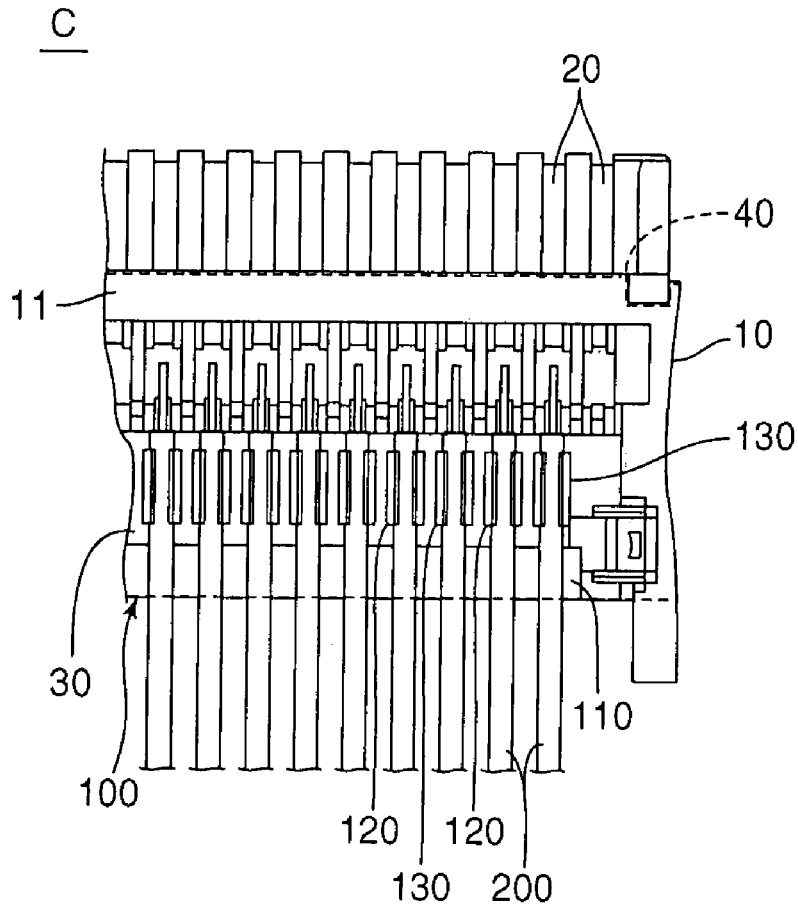
FIG. 4 shows a schematic plan view of a connector including the cable assembly.

A connector "C" that includes the cable assembly A will be described below. FIG. 4 is a schematic plan view of a connector including the cable assembly.

As shown in FIG. 4, the connector C is a plug connector and includes a body 10; a plurality of contacts 20 arranged along a length of one widthwise end of the body 10; a shield terminal 30 provided along the opposite widthwise end of the body 10; a cover 40 attached to the body 10; and the cable assembly A connected to the contacts 20 and the shield terminal 30. For convenience of description, it is assumed below that the first cables 200 are coaxial cables 200*b*.

The topside of the one widthwise end of the body 10 is provided with a convex vein 11 for fixing the plurality of contacts 20.

The contacts 20 are insert molded in the body 10 and fixed by the convex vein 11. The contacts 20 are divided at the convex vein 11 into distal portions and rear portions. The distal portions of the contacts 20 are exposed from the topside of the body 10 so as to be contactable with respective contacts of a receptacle connector which is not shown. On the other hand, the rear portions of the contacts 20 are exposed from the topside of the body 10 so as to be contactable with the respective signal lines 210*b* of the coaxial cables 200*b* in the cable assembly A.

The shield terminal 30 is exposed from a topside of the aforementioned opposite widthwise end of the body 10 so as to be contactable with the cable attachment 100. The shield terminal 30 is also exposed from an underside of the body 10 and is connected to a ground portion of a circuit board which is not shown.

The cover 40 is a shield cover. When the cover 40 is attached to the body 10, the shield terminal 30 is sandwiched between the cover 40 and the body 10 and the cover 40 comes into contact with the shield terminal 30 for electrical connection.

The steps of connecting the coaxial cables 200*b* in the cable assembly A to the contacts 20 and the steps of connecting the cable attachment 100 in the cable assembly A to the shield terminal 30 will be described below.

First, the respective signal lines 210*b* of a plurality of coaxial cables 200*b* are positioned and brought into contact with respective rear portions of a plurality of the contacts 20. The signal lines 210*b* are thus connected to the contacts 20.

Along with this, a base portion 110 of the cable attachment 100 is brought into contact with the shield terminal 30. The cable attachment 100 is thus connected to the shield terminal 30.

In this condition, a cover 40 is attached to a body 10. Accordingly, the base portion 110 of the cable attachment 100 is sandwichingly secured between the shield terminal 30 and the cover 40.

In the connector C as described above, the use of the cable assembly A will ease connection between the plurality of first cables 200 and the plurality of contacts 20. Moreover, upon connecting the first cables 200 to the contacts 20, the cable attachment 100 comes into contact and electrical connection with the shield terminal 30. That is, connection between the first cables 200 and the contacts 20 and connections between the cable attachment 100 and the shield terminal 30 can be simultaneously established, resulting in reduced costs for assembly.

Second Embodiment

Figure 5:
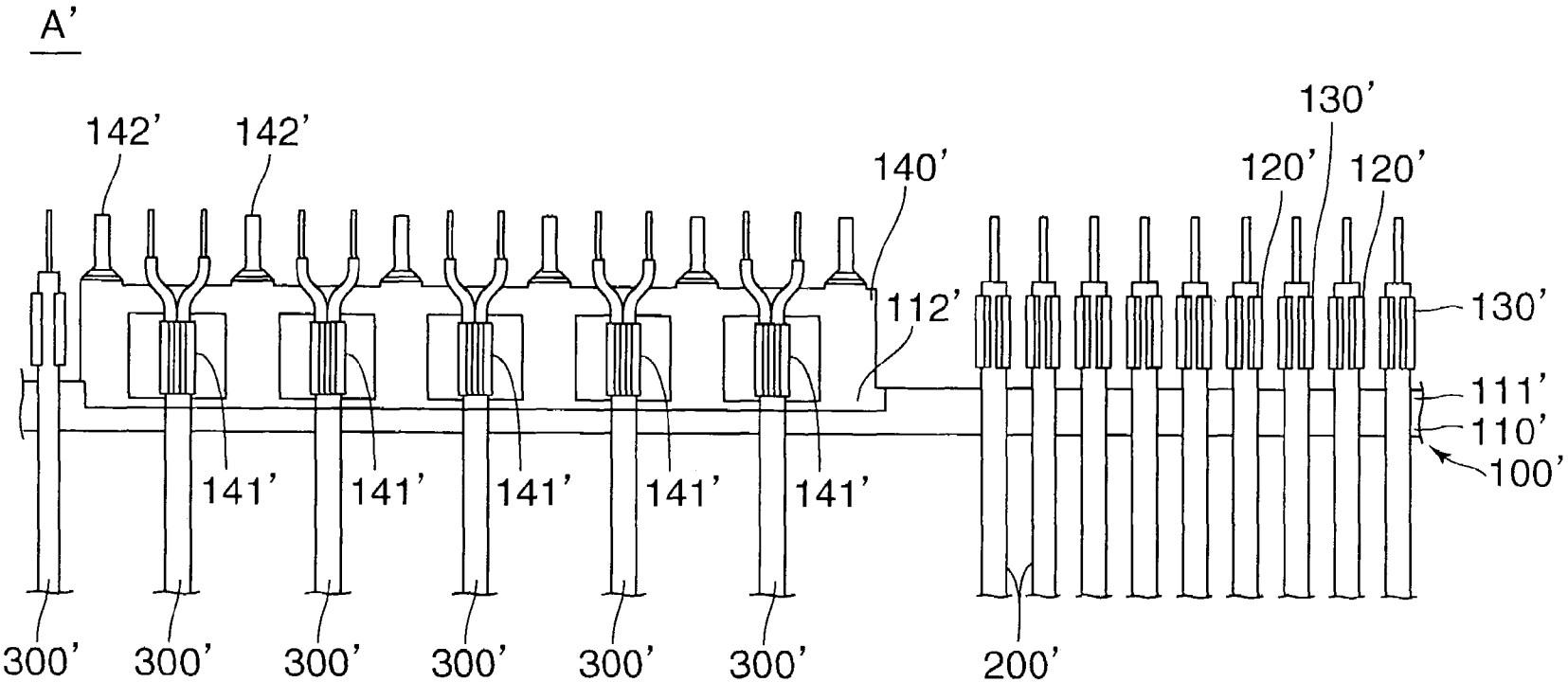
FIG. 5 shows a schematic plan view of a cable assembly according to a second embodiment of the present invention.

Next, a cable assembly according to a second embodiment of the present invention will be described with reference to the drawings. FIG. 5 is a schematic plan view of the cable assembly according to the second embodiment of the present invention.

The cable assembly "A'" shown in FIG. 5 is different from the cable assembly A in that the cable assembly A' further includes an extended portion 140' provided on a second end 112' of abase portion 110' of a cable attachment 100'; and a plurality of second cables 300' which are respectively attached to a plurality of third attachment portions 141' of the extended portion 140'. Hence, the differences will be described in detail and the description of overlapping portions will be omitted.

A first end portion 111' of a base portion 110' of the cable attachment 100' is cut out in a rectangular shape toward a longitudinal end facing the extended portion 140'.

The extended portion 140' is a substantially rectangular plate body extended from the second end 112' of the base portion 110'. A widthwise central portion of the extended portion 140' is provided with the plurality of third attachment portions 141', for attachment thereto of the respective second cables 300', in spaced relation to each other along a length of the base portion 110'. A widthwise distal end portion of the extended portion 140' is provided a plurality of terminals 142' in spaced relation to each other along a length of the base portion 110'. The third attachment portions 141' and the terminals 142' are disposed in an alternating manner.

The third attachment portions 141' are formed by cutting out the extended portion 140' and each have a substantially U-shape in cross section. The third attachment portions 141' each have a substantially I-shaped third supporting portion whose tip and rear ends continue to the extended portion 140'; and a pair of third sandwiching portions provided at opposite ends of the third supporting portion and bent to be oriented in the same direction as first and second sandwiching portions 122' and 132' of first and second type of attachment portions 120' and 130'.

The second cables 300' are twin cables as described above. First cables 200' are single-core cables 200*a* or coaxial cables 200*b*.

The steps of attaching second cables 300' to the cable attachment 100' will be described below. Note that the steps of attaching the first cables 200' are the same as those in the first embodiment and thus description thereof is omitted.

Referring to FIG. 3(*c*), outer insulators, shields, and inner insulators of the second cable 300' are peeled off at the tip sides of first end portions to expose signal lines. Thereafter, the outer insulator at the rear sides of the first ends of the second cables 300' are peeled off to expose shields. In this condition, the shields of the second cables 300' are placed on the third supporting portions of the third attachment portions 141'. Then, pairs of third sandwiching portions are swaged to make the third sandwiching portions sandwich the shields of the second cables 300'.

The cable assembly A' as described above may enjoy the same advantageous effects as those obtained by the cable assembly A. Moreover, not only the first cables 200' but also the second cables 300' can be easily attached, which means that a plurality of types of cables can be attached to the cable assembly.

Figure 6:
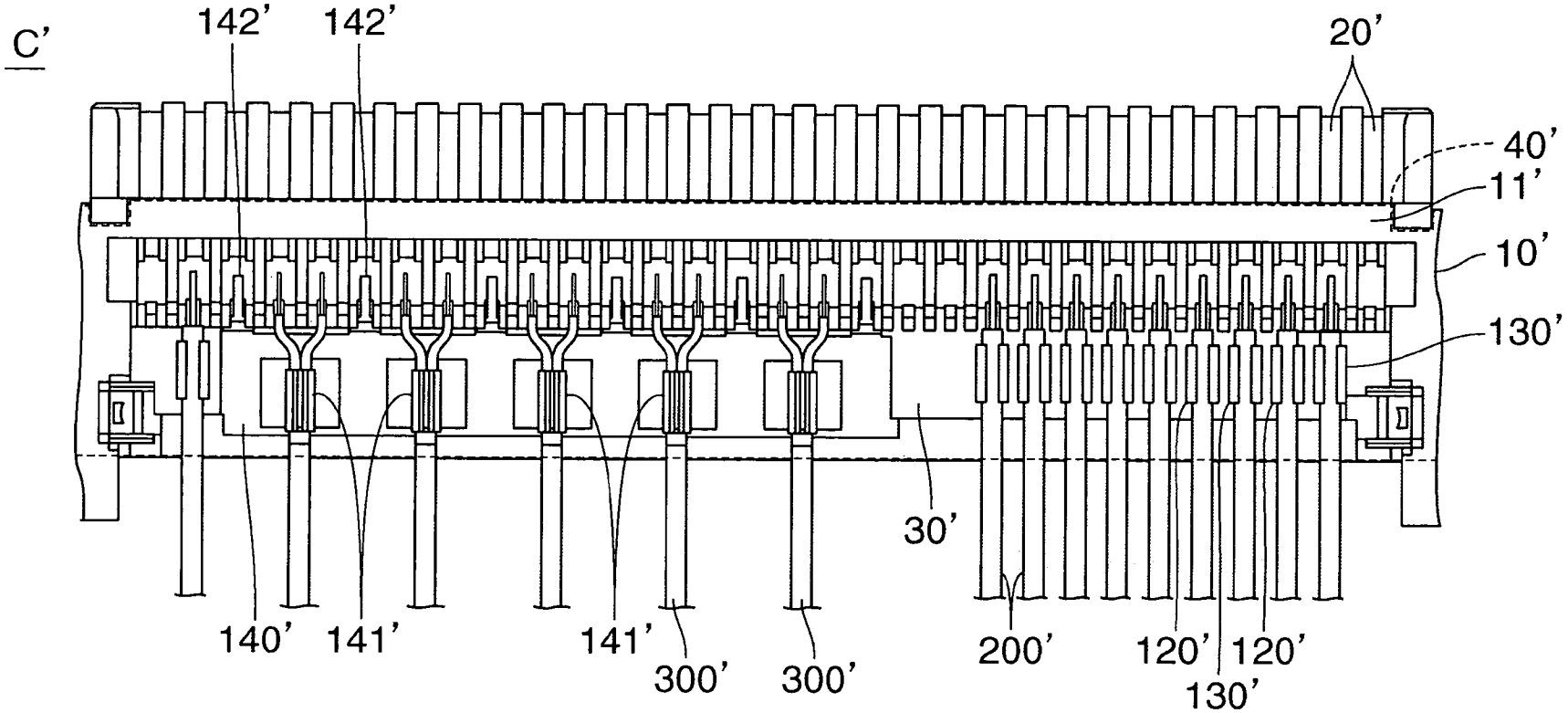
FIG. 6 shows a schematic plan view of a connector including the cable assembly.

A connector "C'" including the cable assembly A' will be described below. FIG. 6 is a schematic plan view of a connector including the cable assembly.

As shown in FIG. 6, the connector C' is a similar kind of plug connector to the connector C. The connector C' is different from the connector C in that the plurality of terminals 142' of the cable attachment 100' are respectively connected to contacts 20' and that the extended portion 140' is connected to the shield terminal 30. The differences will be described in detail below and description of overlapping portions will be omitted. Note that for convenience of description, it is assumed below that first cables 200 are coaxial cables 200*b*.

Signal lines 210*b*' of coaxial cables 200*b*' are connected to corresponding rear portions of contacts 20'. Twins of signal lines of the second cable 300' are also brought into contact with corresponding rear portions of the contacts 20' for electrical connection.

Terminals 142' of extended portions 140' of the cable attachment 100' are brought into contact for electrical connection with the corresponding rear portions of the contacts 20', which are other than the contacts 20' for contact with the first and second cables 200' and 300'. The contacts 20' in contact with the terminals 142' are brought into contact with ground connection contacts of a receptacle connector not shown, and are therethrough connected to a ground portion of a circuit board not shown.

A base portion 110' and an extended portion 140' of the cable attachment 100' come into contact for electrical connection with the shield terminal 30.

In the connector C' as described above, the use of the cable assembly A' will ease connection of the first and second cables 200' and 300' to the contacts 20' of the connector C'. Moreover, upon connecting the first and second cables 200' and 300' to the contacts 20', the cable attachment 100' of the cable assembly A' comes into contact and electrical connection with a shield terminal 30'. That is, connections between the first and second cables 200' and 300' and the contacts 20' and connections between the cable attachment 100' and the shield terminal 30' can be simultaneously established, resulting in reduced costs for both kinds of connections.

Any design changes may be made to the cable attachment as long as it includes a base portion bent such that first and second widthwise end portions thereof are oriented in a same direction; a plurality of first type of attachment portions, arranged in spaced relation to each other along a length of the first end portion of the base portion, for attachment thereto of the corresponding first cables; and a plurality of second type of attachment portions arranged in spaced relation to each other along a length of the second end portion of the base portion for attachment thereto of the corresponding first cables, and the first type of attachment portions and the second type of attachment portions are alternately disposed in the length direction of the base portion.

It was described above that a cable attachment has conductivity. However, if a cable attachment is used to attach thereto single-core cables 200*a* or the like which do not need to establish connection with the shield terminal 30, the cable attachment can be non-conductive. Needless to say, it is possible to provide a base portion of a cable attachment with other attachment portions than first, second, and third attachment portions.

The forms of base portions 110 and 110' is not limited to the aforementioned substantially U-shaped bent one. The base portions may take any form as long as they are bent such that the first and second widthwise end portions are oriented in the same direction.

Any design changes may be made to the forms of the first and second type of attachment portions 120, 130, 120', and 130' as long as first cables 200 can be attached to those attachment portions. The space between the first type of attachment portion 120 or 120' and the respective second type of attachment portion 130 or 130' is not limited to be three times or less than the outer diameter of the first cables 200.

It was described above that base ends of the respective first supporting portions 121 and 121' are bent. Alternatively, second supporting portions 131 and 131' may be bent such that the cable placing sides thereof are flush with the cable placing sides of the first supporting portions 121 and 121'; or both types of the supporting portions, namely the first and second supporting portions 121, 131, 121' and 131', may be bent such that the cable placing sides of both may be allowed to have the same height position. Note that although it is preferable that supporting portions of at least one type, first supporting portions or second supporting portions, be bent and the cable placing sides of both have the same height position, the present invention is not limited thereto.

Although the third attachment portions 141' are provided to an extended portion 140', the present invention is not limited thereto; as with the first and second type of attachment portions 120' and 130', the third attachment portions 141' can be directly provided on the first end portion 111' or the second end portion 112' of a base portion 110'.

Although the single-core cable 200*a*, a coaxial cable 200*b*, and the twin cable 200*c* are shown as examples for first cables 200, the present invention is not limited thereto; needless to say, other cables can be used. The same can also be said for the first cables 200'.

Although a twin cable is shown as an example for second cables 300', the present invention is not limited thereto; needless to say, other cables can be used.

What is claimed is:

1. A cable attachment for attachment thereto of a plurality of first cables in a parallel arrangement, the cable attachment comprising:

a base portion, being a plate body having first and second widthwise end portions;

a plurality of first type of attachment portions, arranged in spaced relation to each other along a length of the first end portion of the base portion, for attachment thereto of the corresponding first cables; and a plurality of second type of attachment portions, arranged in spaced relation to each other along a length of the second end portion of the base portion, for attachment thereto of the corresponding first cables, wherein the first type of each attachment portions each comprise:

a first supporting portion, being a plate body continuing to the first end portion of the base portion, for placing a corresponding one of the first cables thereon; and a pair of first sandwiching portions, continuing to opposite ends of the first supporting portion so as to be oriented in a direction intersecting the length direction, for sandwiching the first cable placed on the first supporting portion, the second type of attachment portions each comprise:

a second supporting portion, being a plate body continuing to the second end portion of the base portion, for placing a corresponding one of the first cables thereon; and a pair of second sandwiching portions, continuing to opposite ends of the second supporting portion so as to be oriented in a direction intersecting the length direction, for sandwiching the first cable placed on the second supporting portion, the base portion is bent such that the first end portion and the second end portion thereof are oriented in the same direction, so that the first type of attachment portions and the second type of attachment portions are alternately disposed in the length direction of the base portion.

2. The cable attachment according to claim 1, wherein the supporting portions of at least one of the first and second types are bent such that cable placing sides of the first supporting portions are arranged flush with cable placing sides of the second supporting portions.

3. The cable attachment according to claim 1, wherein the cable attachment is adapted to receive a second cable in addition to the first cables, and the cable attachment further comprises a third attachment portion, provided on the first end portion or the second end portion of the base portion, for attaching the second cable.

4. The cable attachment according to claim 2, wherein the cable attachment is adapted to receive a second cable in addition to the first cables, and the cable attachment further comprises a third attachment portion, provided on the first end portion or the second end portion of the base portion, for attaching the second cable.

5. A cable assembly comprising:

the cable attachment according to claim 1; and the plurality of first cables for attachment to the respective first and second type of attachment portions of the cable attachment, wherein the first cables are at least one of single-core cables, coaxial cables, and twin cables.

6. A cable assembly comprising:

the cable attachment according to claim 2; and the plurality of first cables for attachment to the respective first and second type of attachment portions of the cable attachment, wherein the first cables are at least one of single-core cables, coaxial cables, and twin cables.

7. A cable assembly comprising:

the cable attachment according to claim 1; and the plurality of first cables for attachment to the respective first and second type of attachment portions of the cable attachment, wherein the first cables each are at least one of coaxial cables and twin cables, and shields of the first cables are attached to the respective first and second type of attachment portions.

8. A cable assembly comprising:

the cable attachment according to claim 2; and the plurality of first cables for attachment to the respective first and second type of attachment portions of the cable attachment, wherein the first cables each are at least one of coaxial cables and twin cables, and shields of the first cables are attached to the respective first and second type of attachment portions.

9. A cable assembly comprising:

the cable attachment according to claim 3; the plurality of first cables for attachment to the respective first and second type of attachment portions of the cable attachment; and the second cable for attachment to the third attachment portion of the cable attachment, wherein the first cables each are at least one of single-core cables and coaxial cables, and the second cable is a twin cable.

10. A cable assembly comprising:

the cable attachment according to claim 4; the plurality of first cables for attachment to the respective first and second type of attachment portions of the cable attachment; and the second cable for attachment to the third attachment portion of the cable attachment, wherein the first cables each are at least one of single-core cables and coaxial cables, and the second cable is a twin cable.

11. A cable assembly comprising:

the cable attachment according to claim 3; the plurality of first cables for attachment to the respective first and second type of attachment portions of the cable attachment; and the second cable for attachment to the third attachment portion of the cable attachment, wherein the first cables are coaxial cables and shields thereof are attached to the respective first and second type of attachment portions, and the second cable is a twin cable and a shield thereof is attached to the third attachment portion.

12. A cable assembly comprising:

the cable attachment according to claim 4; the plurality of first cables for attachment to the respective first and second type of attachment portions of the cable attachment; and the second cable for attachment to the third attachment portion of the cable attachment, wherein the first cables are coaxial cables and shields thereof are attached to the respective first and second type of attachment portions, and the second cable is a twin cable and a shield thereof is attached to the third attachment portion.

13. A connector comprising:

the cable assembly according to claim 5; and a plurality of contacts for connection with the cables.

14. A connector comprising:

the cable assembly according to claim 6; and a plurality of contacts for connection with the cables.

15. A connector comprising:

the cable assembly according to claim 9; and a plurality of contacts for connection with the cables.

16. A connector comprising:

the cable assembly according to claim 10; and a plurality of contacts for connection with the cables.

17. A connector comprising: the cable assembly according to claim 7; a plurality of contacts for connection with the cables; and a shield terminal for contact with the cable attachment.

18. A connector comprising:

the cable assembly according to claim 8;

a plurality of contacts for connection with the cables; and a shield terminal for contact with the cable attachment.

19. A connector comprising:

the cable assembly according to claim 11;

a plurality of contacts for connection with the cables; and a shield terminal for contact with the cable attachment.

20. A connector comprising:

the cable assembly according to claim 12;

a plurality of contacts for connection with the cables; and a shield terminal for contact with the cable attachment.

* * * * *